US009905917B2

(12) United States Patent
Koga et al.

(10) Patent No.: US 9,905,917 B2
(45) Date of Patent: Feb. 27, 2018

(54) ANTENNA DEVICE

(71) Applicant: FUJITSU LIMITED, Kawasaki-shi, Kanagawa (JP)

(72) Inventors: Yohei Koga, Kawasaki (JP); Hiroyuki Egawa, Fukuoka (JP); Yoshihiro Sawada, Inagi (JP); Naozumi Anzai, Kawasaki (JP); Kazutoshi Taniyama, Isehara (JP); Michihiro Konishi, Sagamihara (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 15/054,406

(22) Filed: Feb. 26, 2016

(65) Prior Publication Data

US 2016/0181691 A1 Jun. 23, 2016

Related U.S. Application Data

(63) Continuation of application No. PCT/JP2013/073404, filed on Aug. 30, 2013.

(51) Int. Cl.
*H01Q 1/38* (2006.01)
*H01Q 9/04* (2006.01)
(Continued)

(52) U.S. Cl.
CPC ..... *H01Q 1/38* (2013.01); *H01Q 1/245* (2013.01); *H01Q 9/045* (2013.01);
(Continued)

(58) Field of Classification Search
None
See application file for complete search history.

(56) References Cited

U.S. PATENT DOCUMENTS 6,201,502 B1 3/2001 Kurita et al.
2003/0164797 A1 9/2003 Ngai et al.
(Continued)

FOREIGN PATENT DOCUMENTS

JP 61-041205 2/1986
JP 9-162634 6/1997
(Continued)

OTHER PUBLICATIONS

EESR—The Extended European Search Report of European Patent Application No. 13892395.8 dated Jul. 27, 2016.
(Continued)

*Primary Examiner* — Trinh Dinh
(74) *Attorney, Agent, or Firm* — Fujitsu Patent Center

(57) ABSTRACT

An antenna device includes: a ground electrode; a first dielectric layer which is provided on one surface of the ground electrode; a feed plate which is provided on a surface of the first dielectric layer opposite from the ground electrode, and which is shorted to the ground electrode; a feed line which feeds to the feed plate; a second dielectric layer which is provided in such a manner as to sandwich the feed plate in combination with the first dielectric layer; and a radiation electrode which is provided on a surface of the second dielectric layer opposite from the feed plate, and which is fed by being electrically connected to the feed plate at a feed point and thereby radiates or receives a radiowave with a first frequency.

4 Claims, 11 Drawing Sheets

(51) Int. Cl.
*H01Q 13/10* (2006.01)
*H01Q 1/24* (2006.01)
*H01Q 9/42* (2006.01)

(52) U.S. Cl.
CPC ..... *H01Q 9/0407* (2013.01); *H01Q 9/0421* (2013.01); *H01Q 13/106* (2013.01); *H01Q 9/42* (2013.01)

(56) References Cited

U.S. PATENT DOCUMENTS

2003/0174092 A1 9/2003 Sullivan et al.
2004/0017318 A1 1/2004 Annabi et al.
2004/0058723 A1 3/2004 Mikkola et al.
2004/0090367 A1 5/2004 Montgomery et al.
2004/0183735 A1 9/2004 Jecko et al.
2005/0195110 A1 9/2005 Lin et al.
2005/0259013 A1 11/2005 Gala Gala et al.
2008/0074332 A1 3/2008 Arronte et al.
2008/0122720 A1* 5/2008 Liao ..... H01Q 1/2266 343/846
2008/0231521 A1 9/2008 Anguera Pros et al.
2008/0316118 A1 12/2008 Puente Baliarda et al.
2008/0316121 A1 12/2008 Hobson et al.
2009/0058739 A1* 3/2009 Konishi ..... G06F 1/1616 343/702
2009/0256759 A1 10/2009 Hill et al.
2010/0079351 A1* 4/2010 Huang ..... H01Q 1/48 343/846
2012/0013518 A1* 1/2012 Konishi ..... H01Q 1/2275 343/789
2012/0092226 A1 4/2012 Baliarda et al.

FOREIGN PATENT DOCUMENTS

JP 2000-138515 5/2000
JP 2002-135028 5/2002
JP 2003-234613 8/2003
JP 2004-531153 10/2004
JP 2005-531177 10/2005
JP 2005-534242 11/2005
JP 2007-142934 6/2007

OTHER PUBLICATIONS

JPOA—Office Action of Japanese Patent Application No. 2015-533905 dated Sep. 27, 2016, with English translation of the Office Action.
International Search Report, mailed in connection with PCT/JP2013/073404 and dated Dec. 3, 2013 (7 pages).

* cited by examiner

| | HORIZONTAL PLACEMENT SAR[W/kg] | VERTICAL PLACEMENT SAR[W/kg] | ANTENNA RADIATION EFFICIENCY[dB] |
|---|---|---|---|
| 2.3GHz | 0.89 | 0.68 | -3.6 |
| 5.5GHz | 1.53 | 0.63 | -4.0 |

1100

ANTENNA DEVICE

CROSS-REFERENCE TO RELATED APPLICATION

This application is a continuation application and is based upon PCT/JP2013/073404, filed on Aug. 30, 2013, the entire contents of which are incorporated herein by reference.

FIELD

The present invention relates, for example, to an antenna device.

BACKGROUND

A planar inverted F antenna has been proposed as an antenna advantageous for use with a portable wireless apparatus such as a mobile telephone. For example, in an antenna disclosed in US Patent Application No. 2012/0092226, a slot acting as an antenna is formed between two portions of a ground electrode. Further, an antenna element is connected via one terminal to one of the two portions of the ground electrode and is fed via that terminal, and the antenna element is grounded via another terminal to the other of the two portions of the ground electrode.

SUMMARY

In many countries around the world, regulations are implemented to limit human exposure to radiowaves. For example, according to the guidelines set by the US Federal Communications Commission, it is provided that the specific absorption rate (SAR) be held to 1.6 W/kg (1 g tissue) or below for wireless apparatuses such as tablet PCs. On the other hand, in Japan, a ministerial ordinance issued by the Ministry of Public Management, Home Affairs, Posts and Telecommunications requires that the local SAR not exceed 2 W/kg (10 g tissue) for apparatuses such as mobile telephones.

In order to reduce SAR, it is effective to increase the distance between the antenna and the human body. On the other hand, from the standpoint of enhancing portability, it is preferable that the housing of the wireless apparatus equipped with the antenna is made as thin as possible. However, the thinner the housing, the more difficult it becomes to increase the distance between the antenna and the human body.

According to one embodiment, an antenna device is provided. The antenna device includes: a ground electrode; a first dielectric layer which is provided on one surface of the ground electrode; a feed plate which is provided on a surface of the first dielectric layer opposite from the ground electrode and is made of a conductor, and which is shorted to the ground electrode; a feed line which feeds to the feed plate; a second dielectric layer which is provided in such a manner as to sandwich the feed plate with the first dielectric layer; and a radiation electrode which is provided on a surface of the second dielectric layer opposite from the feed plate, and which is fed by being electrically connected to the feed plate at a feed point to radiate or receive a radiowave with a first frequency.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

An antenna device will be described below with reference to the drawings.

The antenna device includes a feed plate between a ground electrode and a radiation electrode, and the radiation electrode is fed via the feed plate. Since a portion of the radiowave radiated from the radiation electrode is blocked by the feed plate or the ground electrode, this arrangement serves to reduce SAR in the human body located on the ground electrode side. Furthermore, in the antenna device, a slit acting as an antenna is formed in the ground electrode, and a portion of the ground electrode is bent in a direction away from the radiation electrode so that the ground electrode is grounded via the bent portion. By thus providing a certain distance between the ground electrode and the human body and thereby reducing the absorption by the human body of the radiowave radiated from the ground electrode, the antenna device reduces SAR.

Figure 1A:
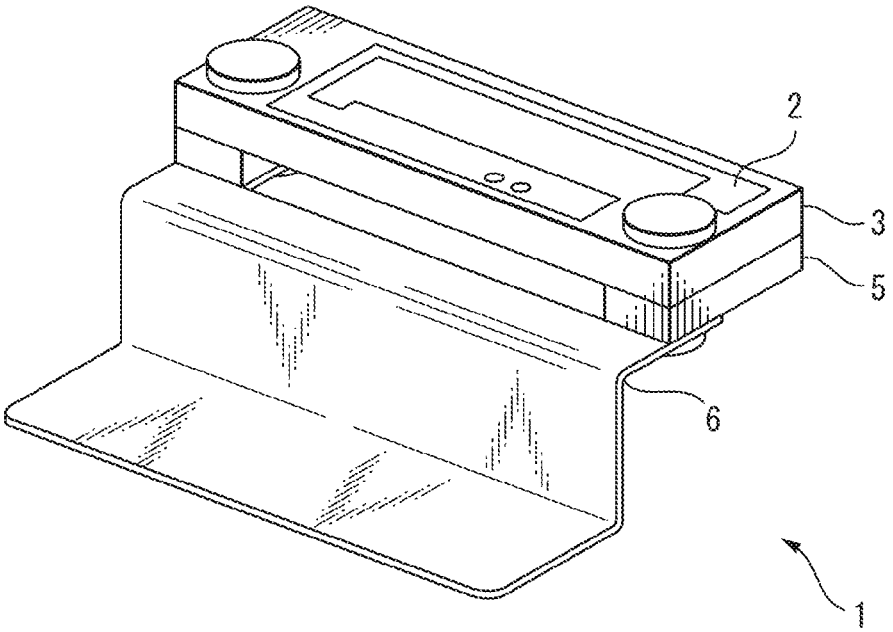
FIG. 1A is a perspective view of an antenna device according to one embodiment as viewed from the top thereof.
Figure 1B:
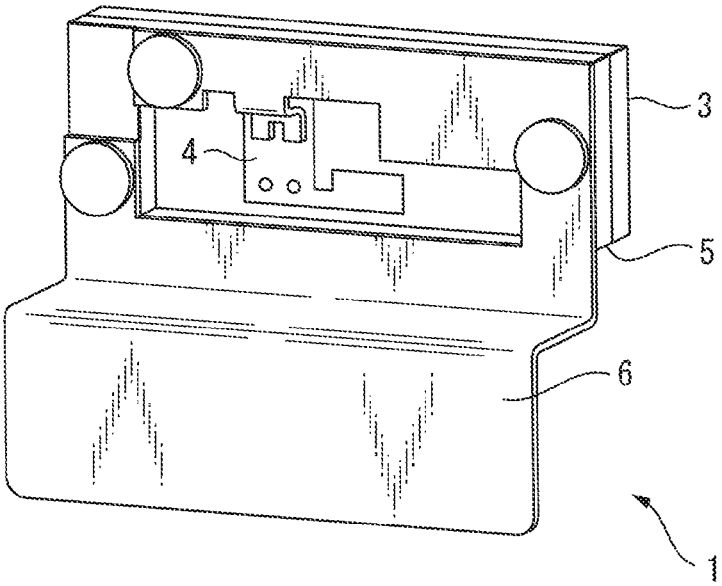
FIG. 1B is a perspective view of the antenna device of FIG. 1A as viewed from the bottom thereof.
Figure 2A:
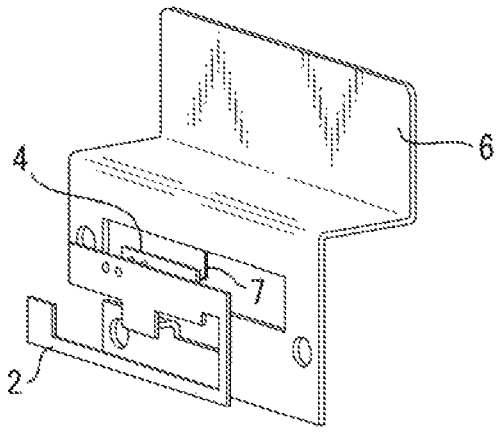
FIG. 2A is a perspective cutaway view depicting the electrodes of the antenna device of FIG. 1A.
Figure 2B:
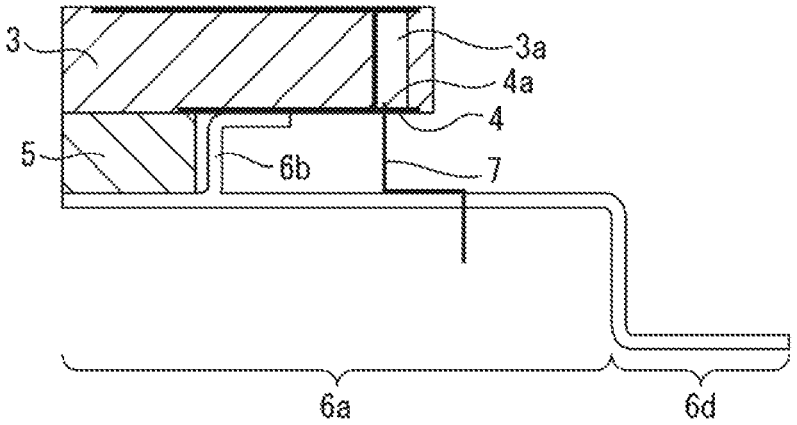
FIG. 2B is a side cutaway view depicting the electrodes of the antenna device of FIG. 1A.
Figure 2C:
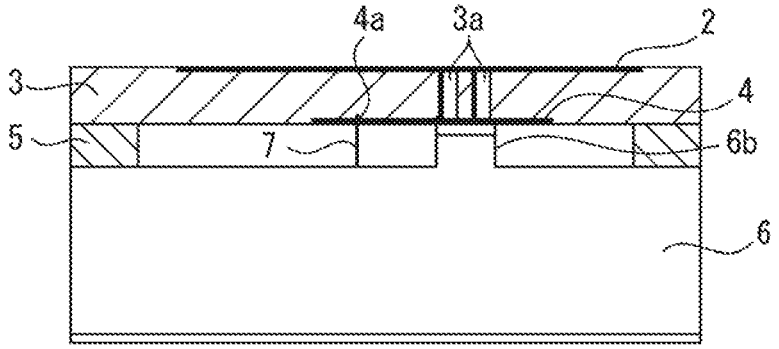
FIG. 2C is a front cutaway view depicting the electrodes of the antenna device of FIG. 1A.

FIG. 1A is a perspective view of the antenna device according to one embodiment as viewed from the top thereof. FIG. 1B is a perspective view of the antenna device of FIG. 1A as viewed from the bottom thereof. FIG. 2A is a perspective cutaway view depicting the electrodes of the antenna device of FIG. 1A. FIG. 2B is a side cutaway view depicting the electrodes of the antenna device of FIG. 1A. FIG. 2C is a front cutaway view depicting the electrodes of the antenna device of FIG. 1A. For convenience of explanation, a plane parallel to the surface of the radiation electrode 2 is hereinafter referred to as the horizontal plane. Further, a direction perpendicular to the horizontal plane is referred to as the vertical direction of the antenna device 1, and the ground electrode is understood to be located at the lowermost end.

As depicted in FIGS. 1A, 1B, and 2A to 2C, the antenna device 1 includes, in order from top to bottom, the radiation electrode 2, the upper dielectric layer 3, the feed plate 4, the lower dielectric layer 5, and the ground electrode 6. The antenna device 1 further includes a feed line 7 which feeds to the feed plate 4 and which is connected to a communication circuit (not depicted) for communicating with other apparatus by means of radiowaves radiated or received by the antenna device 1. The antenna device 1 is mounted in a wireless apparatus, such as a tablet PC, with the ground electrode 6 facing the bottom surface of the housing of the wireless apparatus and with the radiation electrode 2 facing the top surface of the housing.

The radiation electrode 2, the feed plate 4, and the ground electrode 6 are each formed from a metal such as aluminum, copper, gold, silver, or nickel, or an alloy based on some of these metals, or from some other suitable electrically conductive material.

The upper dielectric layer 3 and the lower dielectric layer 5 are each formed, for example, from FR4 or from some other suitable dielectric material. The dielectric material forming the upper dielectric layer 3 and the dielectric material forming the lower dielectric layer 5 may be the same or may be different from each other. The higher the relative permittivity of the dielectric material forming the upper dielectric layer 3, the thinner the upper dielectric layer 3 can be made, i.e., the smaller the spacing between the radiation electrode 2 and the feed plate 4 can be made. Likewise, the higher the relative permittivity of the dielectric material forming the lower dielectric layer 5, the thinner the lower dielectric layer 5 can be made, i.e., the smaller the spacing between the feed plate 4 and the ground electrode 6 can be made.

Figure 3:
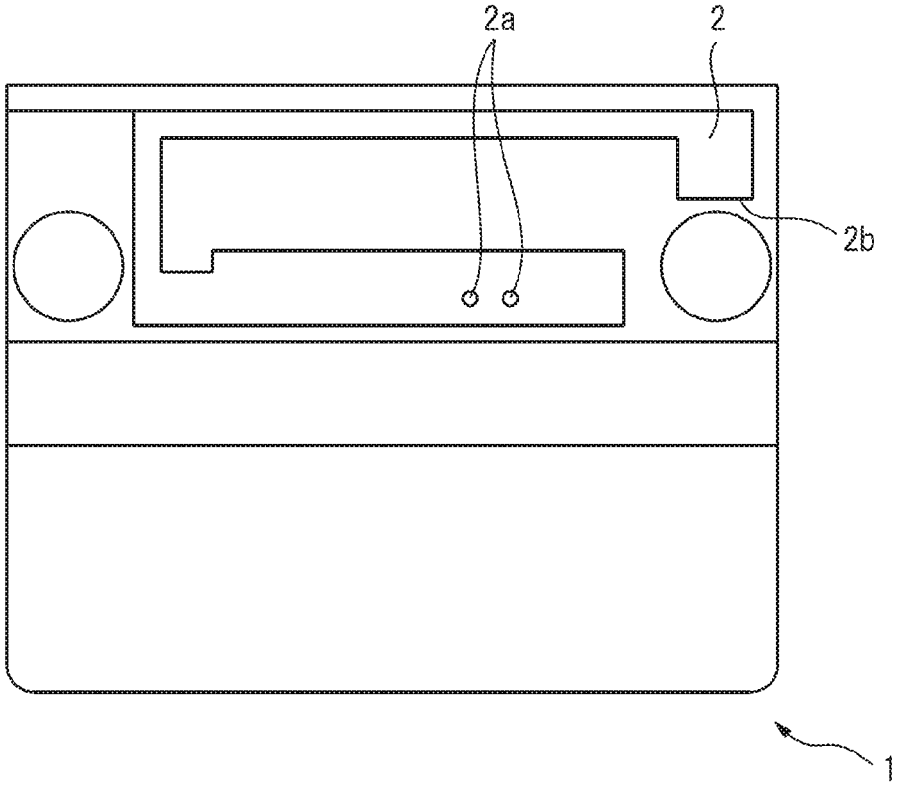
FIG. 3 is a plan view of the antenna device, depicting the shape of a radiation electrode.

FIG. 3 is a plan view of the antenna device 1, depicting the shape of the radiation electrode 2. The radiation electrode 2 is provided on the upper surface of the upper dielectric layer 3, and radiates or receives a radiowave having a first resonant frequency $f_1$. Therefore, the radiation electrode 2 is formed so that the length measured from a feed point 2*a* connected to vias 3*a* formed in the upper dielectric layer 3 to an end 2*b* of the radiation electrode 2 becomes equal to one quarter of a wavelength $\lambda_1$ corresponding to the first resonant frequency $f_1$ so as to be able to resonate with a radiowave having the first resonant frequency $f_1$. Further, in the present embodiment, the radiation electrode 2 is constructed in a substantially U-shaped form in order to reduce the size of the antenna device 1 in the horizontal plane.

The upper dielectric layer 3 is formed with its top surface contacting the radiation electrode 2 and with its bottom surface contacting the top surface of the feed plate 4. The radiation electrode 2 is supported on the upper dielectric layer 3. Two vias 3*a* are formed through the upper dielectric layer 3, and the radiation electrode 2 and the feed plate 4 are electrically connected by the vias 3*a* so that the radiation electrode 2 is fed from the feed plate 4 through the vias 3*a*.

Figure 4:
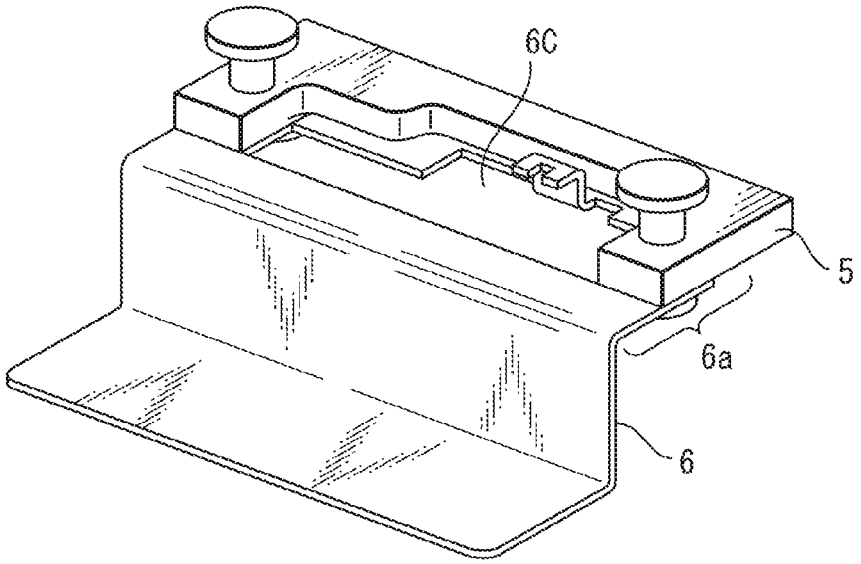
FIG. 4 is a perspective view depicting a surface of a lower dielectric layer.

FIG. 4 is a perspective view depicting a surface of the lower dielectric layer 5. The lower dielectric layer 5 is formed with its top surface contacting the feed plate 4 and with its bottom surface contacting the top surface of the ground electrode 6. In other words, the upper dielectric layer 3 and the lower dielectric layer 5 support the feed plate 4 therebetween so that the feed plate 4 is substantially parallel with the radiation electrode 2. Then, the upper dielectric layer 3 and the lower dielectric layer 5 are fixed together, for example, with resin screws. Alternatively, the upper dielectric layer 3 and the lower dielectric layer 5 may be fixed together by adhesive means.

In the present embodiment, the lower dielectric layer 5 is formed so as not to cover the slit 6*c* formed in the ground electrode 6, but the lower dielectric layer 5 may be formed so as to cover the entire electrode portion 6*a* of the ground electrode 6 including the slit 6*c*.

The feed plate 4 is an electrically conductive plate, and is disposed between the radiation electrode 2 and the ground electrode 6 so as to be substantially parallel with the radiation electrode 2 and the electrode portion 6*a* of the ground electrode 6 and so that the longitudinal direction of the feed plate 4 substantially coincides with the longitudinal direction of the radiation electrode 2. The feed plate 4 is shorted to the ground electrode 6 via a short pin 6*b* of the ground electrode 6. The feed plate 4 is fed via the feed line 7 at a feed point 4*a* which is located at a position different from the position where the short pin 6*b* contacts. Further, the feed plate 4 is electrically connected to the radiation electrode 2 through the two vias 3*a* formed in the upper dielectric layer 3. In this way, the radiation electrode 2 is fed via the feed plate 4 and the feed line 7. The number of vias 3*a* is not limited to any specific number, but the number of vias 3*a* may be one or may be three.

In the present embodiment, the point where the short pin 6*b* contacts the feed plate 4 is spaced away from the vias 3*a* by a prescribed distance along the crosswise direction of the feed plate 4. On the other hand, the vias 3*a* and the feed point 4*a* are spaced away from each other by a prescribed distance along the longitudinal direction of the feed plate 4. The distance between the vias 3 and the contact point and the distance between the feed point 4*a* and the vias 3*a* are each determined according to the resonant frequency $f_1$ of the radiation electrode 2. The lower the resonant frequency $f_1$, the longer the distance between the feed point 4*a* and the vias 3*a*. On the other hand, the distance between the vias 3*a* and the point where the short pin 6*b* contacts the feed plate 4 is set shorter as the resonant frequency $f_1$ becomes lower.

Figure 5A:
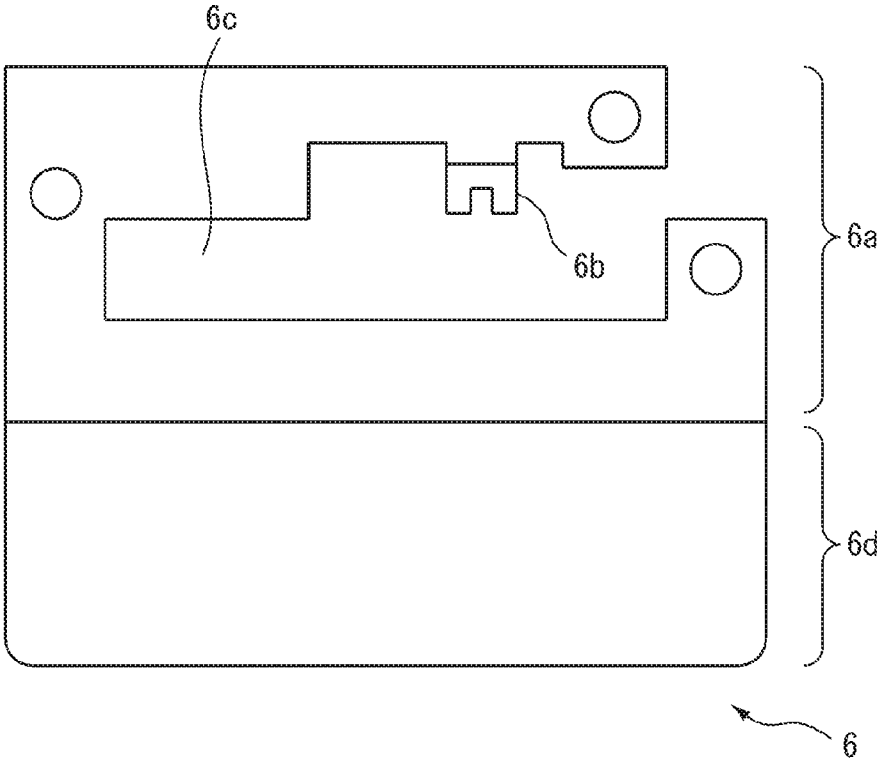
FIG. 5A is a plan view of a ground electrode.
Figure 5B:
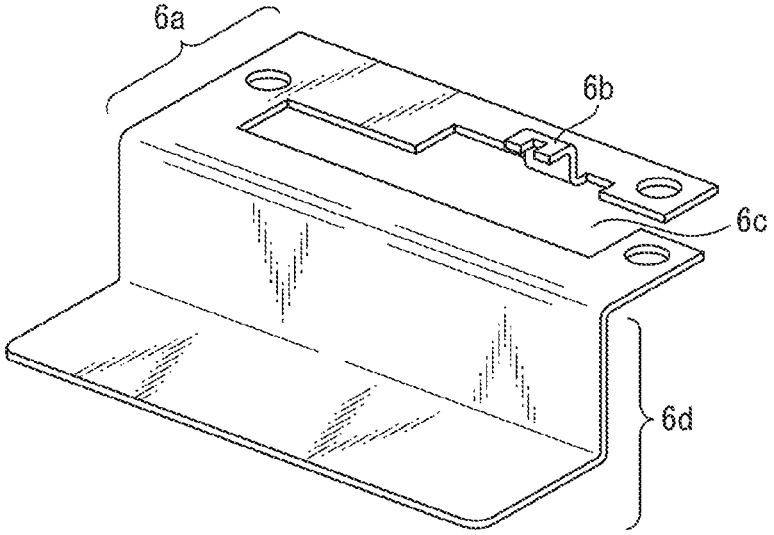
FIG. 5B is a perspective view of the ground electrode.

FIG. 5A is a plan view of the ground electrode 6, and FIG. 5B is a perspective view of the ground electrode 6. The ground electrode 6 is formed, for example, from a metal plate to provide sufficient strength. The ground electrode 6 functions as a grounded conductor with respect to the radiation electrode 2, and also functions as an electrode for radiating or receiving a radiowave having a second resonant frequency $f_2$. For this purpose, the ground electrode 6 has a grounding portion 6*d* in addition to the electrode portion 6*a*. The electrode portion 6*a* of the ground electrode 6 is disposed in contact with the bottom surface of the lower dielectric layer 5 and substantially parallel with the radiation electrode 2 and the feed plate 4. The short pin 6*b* protruding upward is formed on the electrode portion 6*a* in order to short the feed plate 4.

Further, the slit 6*c* is formed in the electrode portion 6*a* of the ground electrode 6. The slit 6*c* is disposed so that the longitudinal direction of the slit 6*c* substantially coincides with the longitudinal direction of the radiation electrode 2 in order to allow a portion of the radiowave radiated from the radiation electrode 2 to pass through.

The slit 6*c* acts as an antenna for radiating or receiving a radiowave having the second resonant frequency $f_2$. To achieve this purpose, the slit 6*c* is formed so that the diagonal length of the slit 6*c* becomes equal to one quarter of a second wavelength $\lambda_2$ corresponding to the second resonant frequency $f_2$. Further, the ground electrode 6 is connected to the feed line 7 at a position near the slit 6*c* and is fed via the feed line 7. The feed line 7 contacts the ground electrode 6 at a position where the impedance of the antenna formed by the slit 6*c* becomes equal to a predetermined value (for example, 50Ω).

The grounding portion 6*d* of the ground electrode 6 is bent at a substantially right angle downward in a direction away from the radiation electrode 2. Then, at the bottom of the antenna device 1, the grounding portion 6*d* is bent at a substantially right angle so as to contact a conducting portion which is electrically connected to a metal plate acting as the ground electrode of the entire housing of the wireless apparatus equipped with the antenna device 1. In this way, the distance from the slit 6*c* to the bottom surface of the housing is increased. Since the increased distance serves to reduce the amount of the radiowave radiated from the slit 6*c* and the grounding portion 6*d* and absorbed by the human body located at a position contacting the bottom surface of the wireless apparatus, the antenna device 1 can reduce SAR.

In the present embodiment, the ground electrode 6 is formed so that the width of the conductor forming the electrode portion 6*a* of the ground electrode 6 becomes larger than the width of the radiation electrode 2. Further, in the present embodiment, the feed plate 4 and the ground electrode 6 are arranged so that when the feed plate 4 and the ground electrode 6 are projected on the horizontal plane, at least a portion of the feed plate 4 overlaps the slit 6*c*. Then, the radiation electrode 2, the feed plate 4, and the ground electrode 6 are arranged so that when the radiation electrode 2, the feed plate 4, and the ground electrode 6 are projected on the horizontal plane, the radiation electrode 2 substantially overlaps the ground electrode 6 or the feed plate 4. With this arrangement, a portion of the radiowave radiated from the radiation electrode 2 and directed toward the bottom of the antenna device 1 is blocked by the feed plate 4 or the ground electrode 6. Furthermore, in the present embodiment, the radiation electrode 2 and the feed plate 4 are arranged so that when the radiation electrode 2 and the feed plate 4 are projected on the horizontal plane, the feed point 2*a* of the radiation electrode 2 and its surrounding portion overlap the feed plate 4. As a result, the radiowave radiated from the feed point 2*a* and its surrounding portion where the current flowing through the radiation electrode 2 becomes strongest is blocked by the feed plate 4. This serves to reduce the amount of the radiowave radiated from the radiation electrode 2 and absorbed by the human body located below the ground electrode 6. In this way, the antenna device 1 can reduce SAR.

On the other hand, it is preferable that the area of the feed plate 4 is smaller than the area of the radiation electrode 2. In the present embodiment, since the feed plate 4 is smaller than the slit 6*c*, the radiation electrode 2, the feed plate 4, and the ground electrode 6 are arranged so that a portion of the radiation electrode 2 does not overlap the feed plate 4 but overlaps the slit 6*c*. As a result, a portion of the radiowave radiated from the radiation electrode 2 is allowed to be radiated outside the antenna device 1 without being blocked by the feed plate 4 or the ground electrode 6; this serves to substantially prevent degradation of the radiating characteristics of the antenna device 1 for a radiowave having a wavelength that resonates the radiation electrode 2.

Further, since the feed plate 4 is smaller than the slit 6*c*, a portion of the radiowave radiated from the slit 6*c* is allowed to be radiated outside the antenna device 1 without being blocked by the feed plate 4. This serves to substantially prevent degradation, due to the presence of the feed plate 4, of the performance of the antenna device 1 for a radiowave having a wavelength corresponding to the resonant frequency $f_2$ of the slit 6*c*.

The dimensions of the various portions of the antenna device 1 and the results of analysis of the SAR and radiation efficiency of the antenna device 1 will be described below for the case where the first resonant frequency $f_1$ of the radiation electrode 2 is 2.3 GHz and the second resonant frequency $f_2$ of the slit 6*c* is 5.5 GHz.

Figure 6:
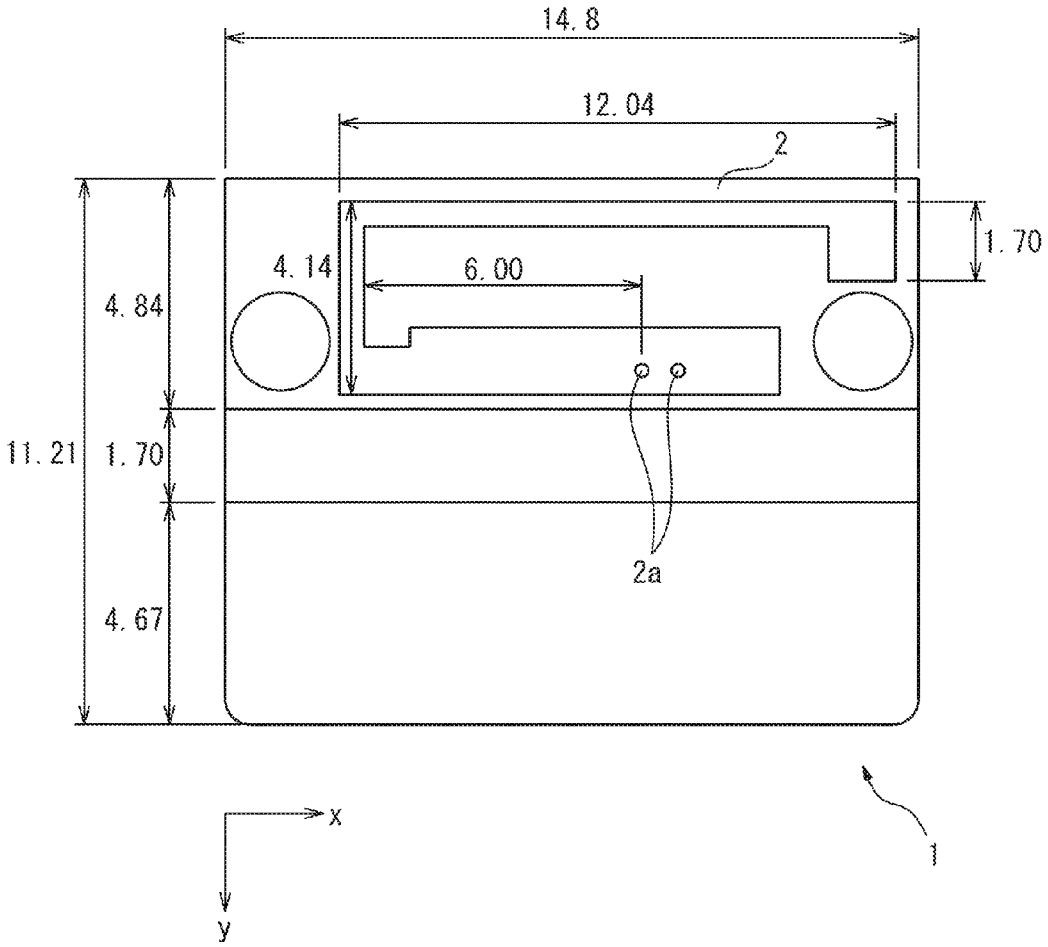
FIG. 6 is a plan view indicating the outer dimensions of the antenna device and the dimensions of the radiation electrode.
Figure 7:
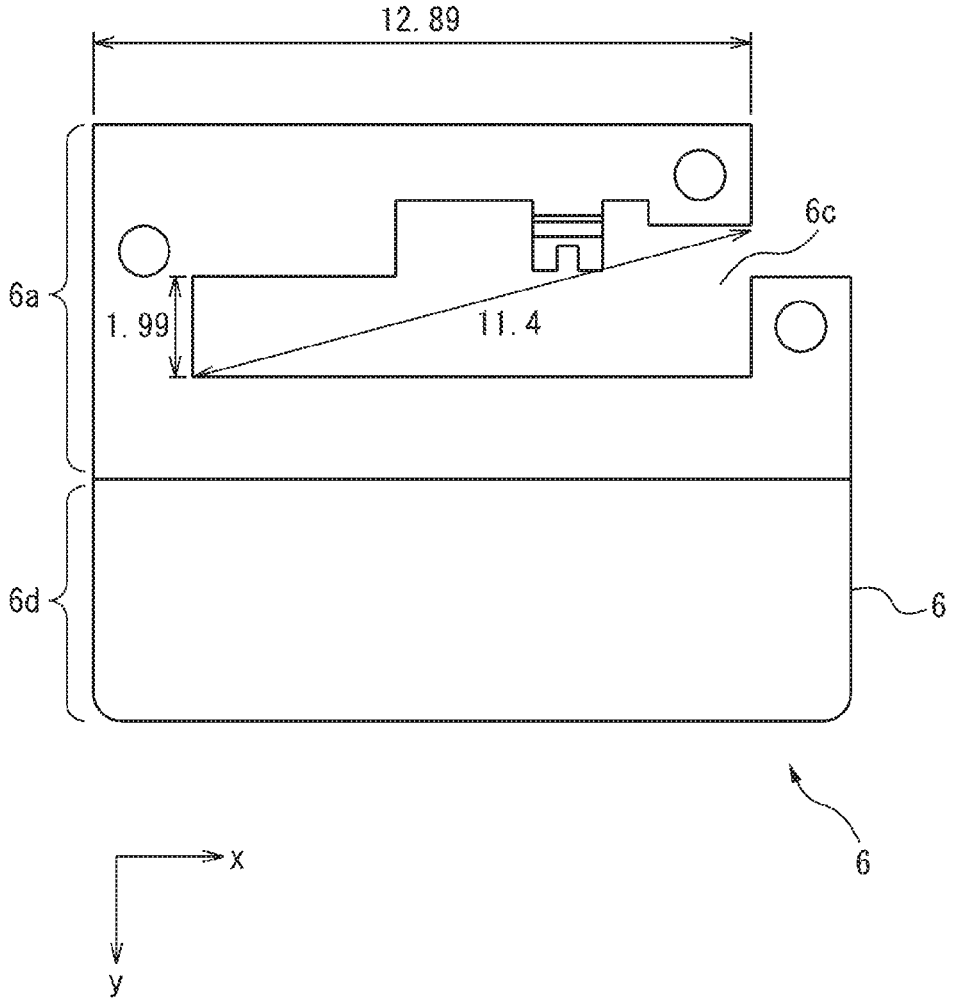
FIG. 7 is a plan view indicating the dimensions of the ground electrode.

FIG. 6 is a plan view indicating the outer dimensions of the antenna device 1 and the dimensions of the radiation electrode 2. FIG. 7 is a plan view indicating the dimensions of the ground electrode 6. The antenna device 1 has a length of 14.8 mm as measured along the longitudinal direction (hereinafter referred to as the x direction) of the radiation electrode 2, and a length of 11.21 mm as measured along the direction (hereinafter referred to as the y direction) orthogonal to the x direction in the horizontal plane. In the substantially U-shaped radiation electrode 2, the length from the feed point 2*a* to the left edge is 6 mm, and the length of the radiation electrode 2 in the y direction is 4.14 mm. The length of the radiation electrode 2 in the x direction is 12.04 mm. The length, in the y direction, of the end portion of the radiation electrode 2 is 1.7 mm.

The length, in the x direction, of the electrode portion 6*a* of the ground electrode 6 is 14.8 mm, and the length in the y direction is 6.54 mm. The length, in the x direction, of the portion of the electrode portion 6*a* located farther from the grounding portion 6*d* is 12.89 mm. The width of the narrowest portion of the slit 6*c* is 1.99 mm, and the diagonal length of the slit 6*c* is 11.4 mm.

Figure 8:
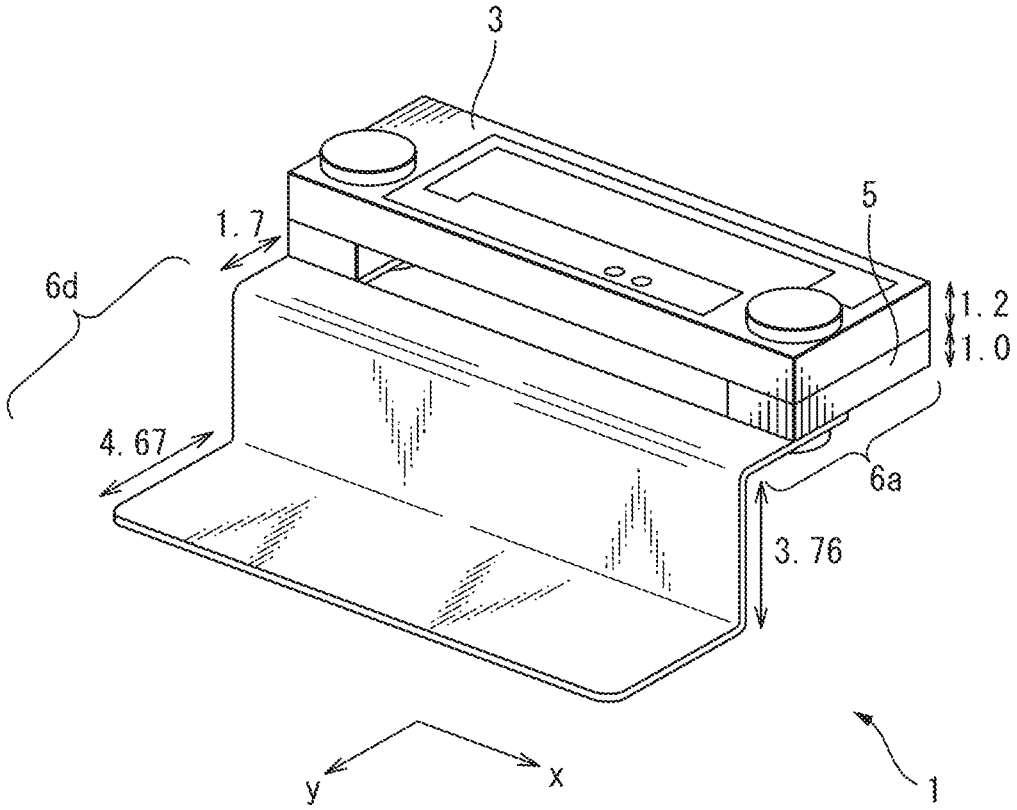
FIG. 8 is a perspective view of the antenna device, indicating the dimensions of various portions in vertical direction.

FIG. 8 is a perspective view of the antenna device 1, indicating the dimensions of the various portions in the vertical direction. As depicted in FIG. 8, the thickness of the upper dielectric layer 3 is 1.2 mm, and the thickness of the lower dielectric layer 5 is 1.0 mm. The relative permittivity of the upper dielectric layer 3 is 3.5, and the relative permittivity of the lower dielectric layer 5 is 2.9.

In the electrode portion 6*a* of the ground electrode 6, the length from the edge portion of the lower dielectric layer 5 to the grounding portion 6*d* is 1.7 mm, and the length of the grounding portion 6*d* in the vertical direction is 3.76 mm. The length, in the y direction, of the bottom portion of the grounding portion 6*d* which is electrically connected to the conductor of the housing is 4.67 mm.

Figure 9:
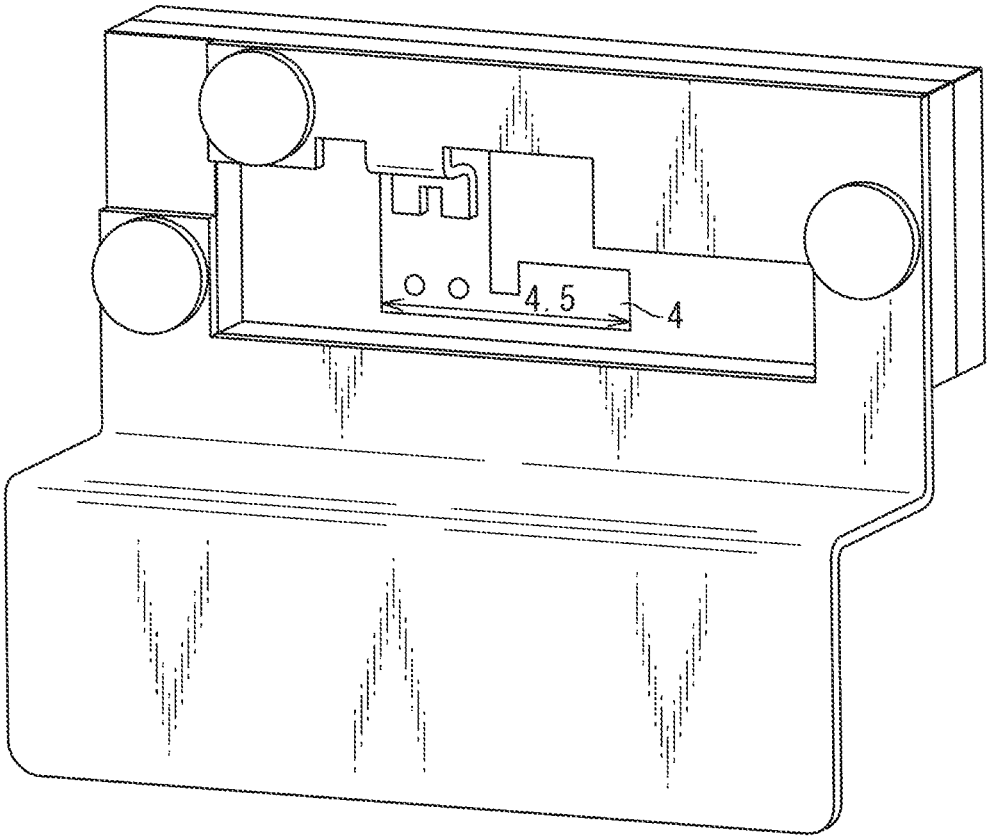
FIG. 9 is a perspective view of the antenna device, indicating the size of a feed plate.

FIG. 9 is a perspective view of the antenna device 1, indicating the size of the feed plate 4. The length of the feed plate 4 in the x direction is 4.5 mm.

Figure 10A:
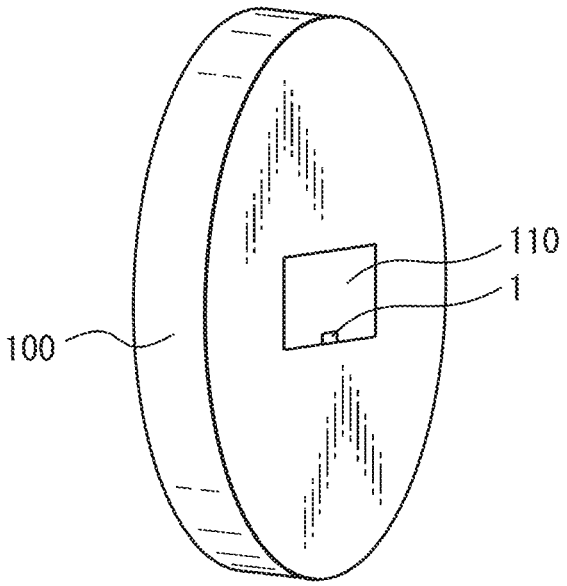
FIG. 10A is a diagram illustrating an arrangement of a phantom and a wireless apparatus, which corresponds to a situation where the wireless apparatus equipped with the antenna device is placed on a lap.
Figure 10B:
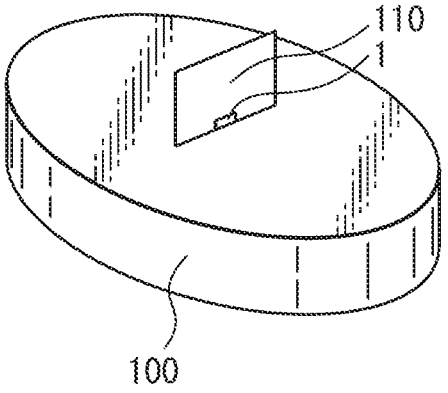
FIG. 10B is a diagram illustrating an arrangement of a phantom and a wireless apparatus, which corresponds to a situation where the wireless apparatus equipped with the antenna device is placed on a belly.

FIG. 10A is a diagram illustrating an arrangement of a phantom and a wireless apparatus, which corresponds to a situation where the wireless apparatus equipped with the antenna device 1 is placed on a lap. FIG. 10B is a diagram illustrating an arrangement of a phantom and a wireless apparatus, which corresponds to a situation where the wireless apparatus equipped with the antenna device 1 is placed on a belly. In the illustrated examples, the antenna device 1 is placed with its ground electrode disposed facing the bottom surface of the wireless apparatus 110 and in close proximity to one side of the wireless apparatus 110.

In the example illustrated in FIG. 10A, the wireless apparatus 110 equipped with the antenna device 1 is placed so that the bottom surface of the wireless apparatus 110 contacts the surface of the phantom 100. For convenience, this placement is hereinafter referred to as the horizontal placement. On the other hand, in the example illustrated in FIG. 10B, the wireless apparatus 110 equipped with the antenna device 1 is placed so that the bottom surface of the wireless apparatus 110 is perpendicular to the surface of the phantom 100 and so that the side on which the antenna device 1 is mounted contacts the phantom 100. For convenience, this placement is hereinafter referred to as the vertical placement.

The relative permittivity of the phantom used for analysis is 51.2 for 2.3 GHz and 48.7 for 5.5 GHz, the conductivity is 1.92 [S/m] for 2.3 GHz and 5.82 [S/m] for 5.5 GHz, and the density is 1000 [kg/m$^3$]. The input power to the antenna device 1 is 16.0 [dBm] for 2.3 GHz and 17.0 [dBm] for 5.5 GHz.

Figures 11, 12:
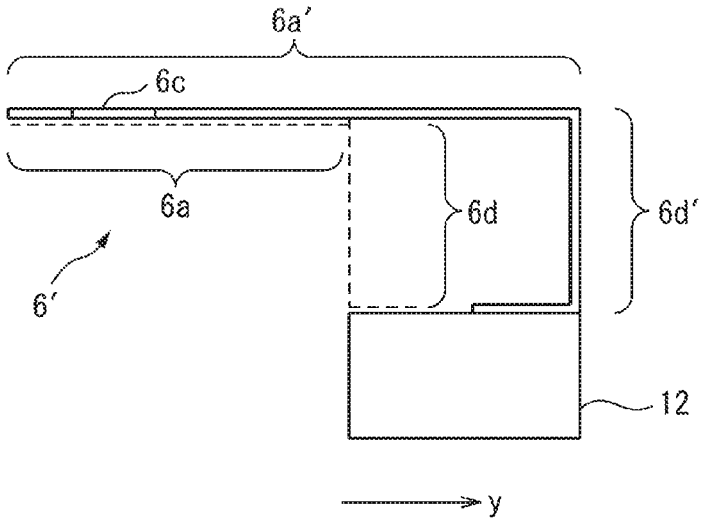
FIG. 11 is a table indicating the results of analysis of the SAR and radiation efficiency of the antenna device.
FIG. 12 is a schematic side view of a ground electrode according to a modified example.

FIG. 11 is a table indicating the results of the analysis of the SAR and radiation efficiency of the antenna device 1 performed using the Finite-Difference Time-Domain method. As indicated in Table 1100, SAR is less than 1.6 [w/kg] for both of the first resonant frequency of 2.3 GHz and the second resonant frequency of 5.5 GHz, whether the placement be the horizontal placement or the vertical placement. The analysis of the radiation efficiency of the antenna device 1 also indicated good values, −3.6 [dB] for the first resonant frequency of 2.3 GHz and −4.0 [dB] for the second resonant frequency of 5.5 GHz. It is thus seen that the antenna device 1 achieves good performance in terms of both SAR and radiation efficiency.

As has been described above, in the antenna device, since the feed plate is provided between the radiation electrode and the ground electrode, and the radiation electrode is fed via the feed plate, a portion of the radiowave radiated from the radiation electrode is blocked by the feed plate or the ground electrode, and as a result, SAR is reduced. Furthermore, in the antenna device, one end of the ground electrode is bent in a direction away from the radiation electrode, i.e., toward the bottom side, and is grounded to the conducting portion of the housing of the wireless apparatus. Accordingly, in the antenna device, since the spacing between the human body and the slit formed in the ground electrode and acting as an antenna can be made relatively large, the absorption by the human body of the radiowave radiated from the slit can be reduced, even when the human body is located on the bottom side of the housing. As a result, the antenna device can reduce SAR.

The present invention is not limited to the above embodiment.

FIG. 12 is a schematic side view of a ground electrode according to a modified example, depicting the shape of the ground electrode. Compared with the electrode portion 6*a* and grounding portion 6*d* of the ground electrode 6 indicated by dashed lines, the ground electrode 6' according to the modified example of FIG. 12 differs in that its electrode portion 6*a*' is extended in the y direction up to an end corresponding to the housing side end of the conducting portion 12 connected to the ground electrode (not depicted) of the entire housing. Then, the grounding portion 6*d*' is bent toward the housing side end of the conducting portion 12. As a result, the path of the current from the slit 6*c* formed in the ground electrode 6' to the conducting portion 12 becomes longer than the corresponding path in the above embodiment, and thus the current in the vicinity of the conducting portion 12 becomes smaller. Since this reduces the intensity of electromagnetic radiation in the vicinity of the human body located on the bottom side of the housing, SAR is further reduced.

According to another modified example, the antenna device may be configured to radiate or receive only radiowaves having a frequency with which the radiation electrode resonates. In this case, the distance from the ground electrode to the human body may be made shorter than in the case of the above embodiment, because there is no need to consider the radiowave radiated from the slit of the ground electrode. Accordingly, the ground electrode may be formed in a flat plate-like shape.

According to still another modified example, the antenna device may include an additional dielectric layer located upwardly of the radiation electrode and an additional radiation electrode supported on the additional dielectric layer and capable of radiating or receiving a radiowave having a third resonant frequency. This additional radiation electrode is fed, for example, through a via formed in the additional dielectric layer in the same position as the via formed in the second dielectric layer.

By providing the additional radiation electrode, the antenna device can radiate or receive radiowaves of three different frequencies. It is preferable to arrange the additional radiation electrode so that when the additional radiation electrode, the feed plate, and the ground electrode are projected on the horizontal plane, the additional radiation electrode substantially overlaps the ground electrode or the feed plate. In this case, since a portion of the radiowave radiated from the additional radiation electrode is blocked by the feed plate or the ground electrode, SAR can also be reduced for the radiowave radiated from the additional radiation electrode.

According to yet another modified example, the radiation electrode may be formed in a straight line shape, or may be formed in an S shape or L shape. In this case, it is preferable to form the electrode portion of the ground electrode so as to have a shape geometrically similar to the shape of the radiation electrode. In this case also, it is preferable to arrange the feed plate and the ground electrode so that when the radiation electrode, the feed plate, and the ground electrode are projected on the horizontal plane, most of the radiating portion overlaps the feed plate or the ground electrode. Since, in this case, a portion of the radiowave radiated from the radiation electrode toward the bottom of the antenna device is blocked by the feed plate or the ground electrode, SAR is reduce in the human body located on the bottom side. Further, since the other portion of the radiowave can be radiated outside the housing equipped with the antenna device, the antenna device can communicate with an apparatus outside the housing.

Figure 13:
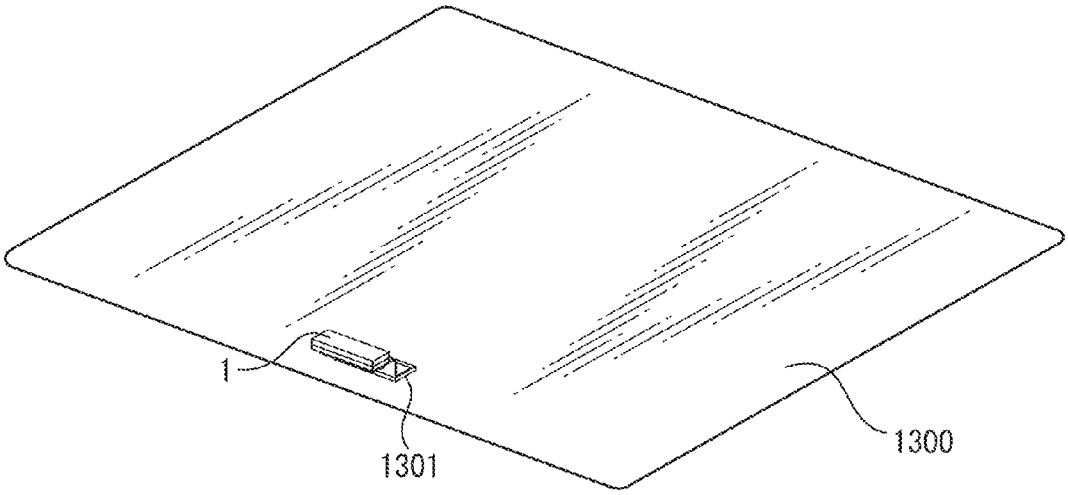
FIG. 13 is a diagram depicting one example of the placement of the antenna device in a wireless apparatus according to the embodiment or modified example.

FIG. 13 is a diagram depicting one example of the placement of the antenna device in a wireless apparatus according to the above embodiment or modified example. The antenna device 1 is placed inside the rectangular-parallelepiped-shaped housing of the wireless apparatus, with the ground electrode 6 of the antenna device 1 facing the bottom surface 130 of the housing and with the radiation electrode 2 facing the top surface (not depicted) of the housing. On the other hand, a user interface such as a touch panel display (not depicted) is placed face up, i.e., to face the top surface of the housing. Therefore, generally the wireless apparatus is used with the bottom surface of the housing placed on a portion of the human body (for example, a lap). The bottom surface and top surface of the housing are formed from dielectric material such as a resin. The antenna device 1 is placed in such a manner that the bottom of the grounding portion of the ground electrode 6 contacts the conducting portion 1301 electrically connected to the ground electrode (not depicted) of the housing itself. It is preferable that the ground electrode of the housing itself is spaced away from the antenna device 1 so that the antenna device 1 can receive a radiowave from outside the housing and can transmit a radiowave outside the housing. It is also preferable that the antenna device 1 is placed, for example, in the vicinity of one of the sides of the housing in such a manner that the longitudinal direction of the slit and the radiation electrode is substantially parallel with the one side. In this case, when the wireless apparatus is placed in such a manner that the side of the housing in the vicinity of which the antenna device 1 is placed faces the human belly, SAR in the human belly is reduced.

The orientation of the antenna device 1 may be determined according to the placement of the conducting portion so that the electrode portion of the ground electrode is located nearer to the side of the housing than the grounding portion is, or conversely, the orientation of the antenna device 1 may be determined so that the grounding portion of the ground electrode is located nearer to the side of the housing than the electrode portion is.

Alternatively, the antenna device 1 may be placed in the vicinity of one of the corners of the housing. Since the current is relatively strong in the vicinity of the feed point of the radiation electrode, it is preferable that the feed point is located as far away from the human body as possible. In particular, when the wireless apparatus is placed in such a manner that the side of the housing in the vicinity of which the antenna device 1 is placed faces the human belly, the position nearer to any one of the corners of the housing is farther from the human body, because the human body is substantially elliptical in cross section. Therefore, it is preferable to place the antenna device so that the feed point of the radiation electrode is located as close as possible to one of the corners of the housing; for example, when the feed point is located nearer to the left edge than the longitudinal center of the radiation electrode, it is preferable to place the antenna device in the left edge corner of the housing.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of superiority and inferiority of the invention. Although the embodiments of the present invention have been described in detail, it should be understood that the various changes, substitutions, and alterations could be made hereto without departing from the spirit and scope of the invention.

What is claimed is:

1. An antenna device comprising:

a ground electrode;

a first dielectric layer which is provided on one surface of the ground electrode;

a feed plate which is provided on a surface of the first dielectric layer opposite from the ground electrode and is made of a conductor, and which is shorted to the ground electrode;

a feed line which feeds to the feed plate;

a second dielectric layer which is provided in such a manner as to sandwich the feed plate with the first dielectric layer; and a radiation electrode which is provided on a surface of the second dielectric layer opposite from the feed plate, and which is fed by being electrically connected to the feed plate at a feed point to radiate or receive a radiowave with a first frequency, wherein a slit is formed in the ground electrode, and the slit radiates or receives a radiowave with a second frequency, and wherein one end of the ground electrode, where the slit is not formed, is bent in a direction away from the radiation electrode, and the ground electrode is grounded at the one end.

2. The antenna device according to claim 1, wherein the radiation electrode and the feed plate are arranged so that when the feed plate is projected on a surface of the radiation electrode, the feed plate overlaps the feed point.

3. The antenna device according to claim 1, wherein an area of the feed plate is smaller than an area of the radiation electrode.

4. The antenna device according to claim 1, wherein the feed plate and the ground electrode are arranged so that when the feed plate and the ground electrode are projected on the surface of the radiation electrode, at least a portion of the feed plate overlaps the slit.

* * * * *